United States Patent [19]

Bronson

[11] Patent Number: 4,552,063

[45] Date of Patent: Nov. 12, 1985

[54] LINE CODER SELF-INKING SYSTEM WITH DISPOSABLE INK SUPPLY RESERVOIR

[76] Inventor: James C. Bronson, P.O. Box 372, Lakeland, Fla. 33802

[21] Appl. No.: 673,055

[22] Filed: Nov. 19, 1984

[51] Int. Cl.[4] ..... B41F 17/26

[52] U.S. Cl. ..... 101/35; 101/331; 401/209

[58] Field of Search ..... 101/35, 328, 329, 330, 101/331; 401/209

[56] References Cited

U.S. PATENT DOCUMENTS

| | | | |
|---|---|---|---|
| 1,369,570 | 2/1921 | Stiles | 101/35 |
| 2,749,838 | 6/1956 | Stover | 101/35 |
| 2,834,285 | 5/1958 | Gottscho et al. | 101/35 |
| 2,905,087 | 9/1959 | Farrell | 101/350 |
| 3,648,601 | 3/1972 | Weidman | 101/35 |
| 4,142,465 | 3/1979 | Kemp | 101/330 |
| 4,145,967 | 3/1979 | Marozzi | 101/328 X |
| 4,152,980 | 5/1979 | Siegal | 101/35 |

FOREIGN PATENT DOCUMENTS

| | | | |
|---|---|---|---|
| 394831 | 5/1924 | Fed. Rep. of Germany | 101/328 |

*Primary Examiner*—Clifford D. Crowder
*Attorney, Agent, or Firm*—Dowell & Dowell

[57] ABSTRACT

A rotatable ink reservoir which is caused to rotate by engagement with a rotatably mounted printing roller has its ink continually replenished in proportion to the rotation of the printing roller by a container of ink having a ball feed discharge element that is mounted on an arm adjacent to the conveyor so that it engages the upper surface of the ink reservoir spaced from its axis.

5 Claims, 2 Drawing Figures

LINE CODER SELF-INKING SYSTEM WITH DISPOSABLE INK SUPPLY RESERVOIR

BACKGROUND OF THE INVENTION

1. Field of the Invention This invention relates to inking systems and particularly those used with conveyors in which articles moving along the conveyor are engaged by an inking member adjacent to the conveyor, the ink being continuously used and requiring resupply.

2. Description of the Prior Art

Devices for supplying inking reservoirs have been known heretofore. For example, in the patent to Gottscho et al., U.S. Pat. No. 2,901,972, and inking supply roller is mounted on an arm which carries a supply container that provides a gravity feed of ink in response to rotation of an inking roll that through a cam produces reciprocation of a valve rod connected to the container.

The patent to Farrell, U.S. Pat. No. 2,905,087, discloses a printing mechanism including a reservoir with a ball type spreader which engages an inking roller.

The patent to Marozzi, U.S. Pat. No. 3,457,854, discloses an ink reservoir device for printing wheels. However, no means for replenishing the supply of ink to the reservoir appears.

SUMMARY OF THE INVENTION

The invention includes a dispensing container for a ball discharge valve which is mounted to engage a rotatably mounted inking reservoir so that the ink supply to the latter is replenished proportionally to the ink's usage by the printing roller which engages the articles being inked and the roller reservoir.

DESCRIPTION OF THE PREFERRED EMBODIMENT

Figure 1:
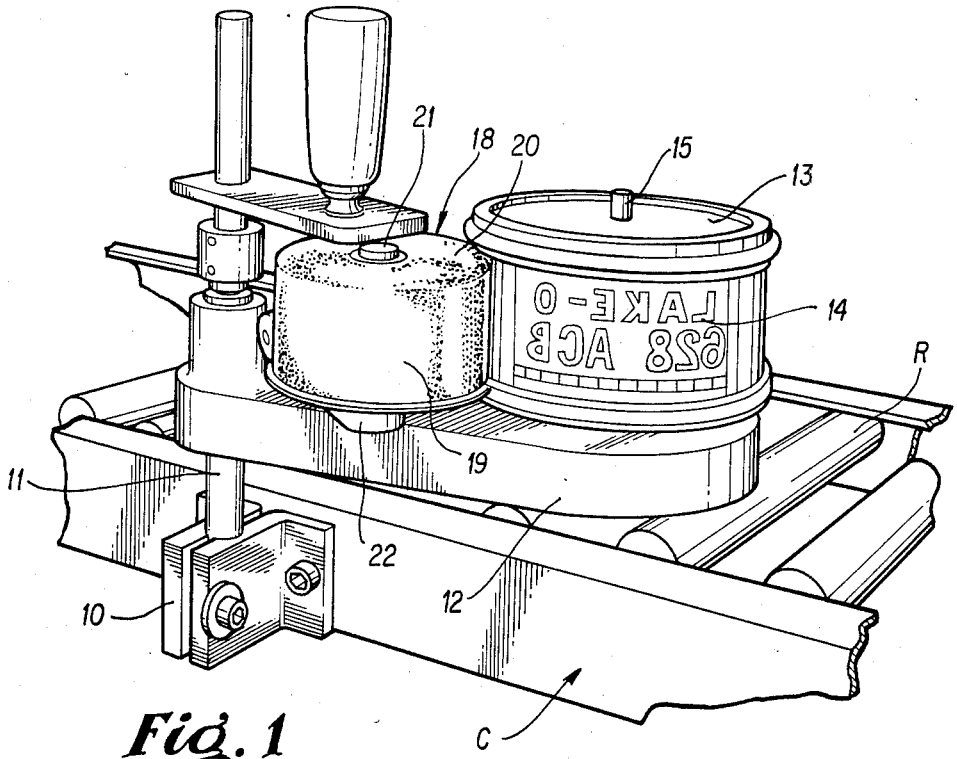
FIG. 1 is a perspective view of a conventional inking system and a device of the present invention mounted in association therewith.
Figure 2:
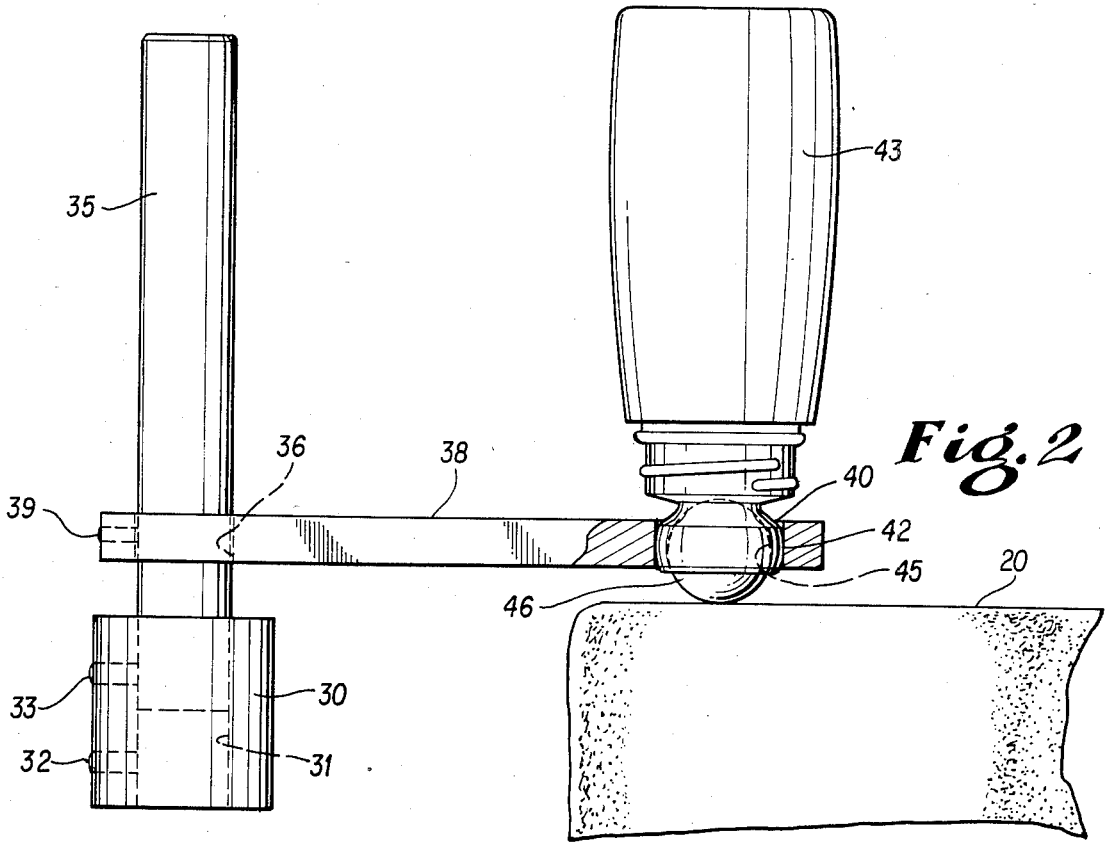
FIG. 2 is an enlarged side elevation, partially in section, illustrating the manner of use of a device in accordance with the present invention.

With further reference to the drawing a conveyor "C" having rollers "R" for the passage of articles such as boxes to be marked, not shown, is illustrated. Mounted on the side frame of the conveyor is a bracket 10 which supports an upright post 11 on which is mounted an arm 12. The arm 12 carries a rotatable drum or printing roller 13 on the outer surface of which a printing die 14 is mounted, the drum being rotatably mounted on a shaft 15.

The arm 12 is resiliently urged by spring means, not shown, so that the periphery of the drum 13 carrying the printing die is urged into the path of articles moving along the conveyor in order to transfer ink from the die onto the article.

In order to provide a continuous coating of ink on the printing die an inking roller reservoir or cartridge 18 having cylindrical surface 19, and an upper substantially horizontal surface 20 is rotatably mounted by shaft 21 on arm 22 which is carried by the arm 12. Resilient means, such as a spring, not shown, is provided in the mounting for urging the inking roller reservoir cylindrical surface 19 into engagement with the printing die 14 of the printing roller.

The structure described thus far is known and in common use in the art of printing.

Applicant's invention includes the provision of a coupling 30 having bore 31 and setscrews 32 and 33. The coupling receives the upper end of the shaft 11 in its lower portion and is fixed thereto by the setscrew 32. An extension rod 35 of appropriate length and size is inserted into the upper end of the bore 31 and fixed therein by the setscrew 33.

A plate or arm 38 is provided having bores at each end. A first bore 36 is of a size to slidably receive the extension rod 35, a setscrew 39 extending into the end of the arm for engagement with the rod 35 to hold the arm 38 in the desired position vertically and laterally.

At the other end of the arm the bore 40 is of a size snugly to receive the outer surface of the discharge outlet 42 of a container 43 for ink. The discharge outlet internally has upper and lower inwardly inclined lip portions providing a cupped wall surface 45 for receiving a ball 46.

The arm 38 is positioned so that the ball 46 makes proper engagement with the upper surface 20 of the inking roller so that upon rotation of the inking roller caused by its engagement with the printing roller whose rotation is caused by engagement with articles moving on a conveyor a flow of ink from the container 43 will be passed onto the inking reservoir which is proportionate to its movement.

The engagement of the discharge end of the container with the opening 42 in the arm permits ready substitution of a filled container as soon as the container in place becomes empty. Thus, the supply of ink may be continuously maintained with little effort and without the necessity of soiling the hands of the operator.

While various ink containers may be used a preferred form is a nonbreakable polyethylene bottle capped with a high density polyethylene ball. The ink is a dye base free flowing coder ink.

I claim:

1. In combination with an a first arm carrying a rotatably mounted printing roller, said arm being mounted by support means adjacent to a conveyor which carries articles that engage the printing roller, and a rotatably mounted inking roller reservoir carried by said arm and in continuous engagement with said printing roller for continuously transferring ink thereto in response to rotation of said rollers caused by engagement of said printing roller with articles passing along said conveyor, the improvement comprising, means for continuously replenishing the supply of ink in said reservoir including post means mounted on said support means, a second arm mounted on said post means above said first arm and having a portion in fixed position spaced from said reservoir, an ink supply container removably mounted on said second arm and having a discharge outlet, said discharge outlet having wall structure carrying a ball which extends beyond said wall structure, said ball extending into engagement with the surface of said reservoir whereby rotation of said reservoir causes a feed of ink from the container to the reservoir by means of the ball, which feed is proportional to the rotation of said marking wheel.

2. The invention of claim 1 in which said arm has a portion in juxtaposition above the top of said reservoir so that the ball engages the reservoir in a position spaced from the axis of rotation thereof.

3. The invention of claim 1 in which walls of said discharge portion of said container are substantially cylindrical and have upper and lower inwardly inclined lip portions for retaining the ball therein.

4. The invention of claim 1 in which the second arm is adjustably mounted on said post means so that its height and horizontal position may be varied.

5. The invention of claim 1 in which the walls of said container above its discharge portion taper slightly outwardly from just above its discharge portion to its remote end there above when the container is mounted for use and in which the ink in said container is a dye base free flowing coder ink.

* * * * *